United States Patent [19]

Ray

[11] 4,339,741

[45] Jul. 13, 1982

[54] THERMALLY ACTUATED TIME DELAY SWITCH

[76] Inventor: William A. Ray, 888 S. Orange Grove Blvd. #3E, Pasadena, Calif. 91105

[21] Appl. No.: 202,772

[22] Filed: Oct. 31, 1980

[51] Int. Cl.[3] ..... H01H 61/02

[52] U.S. Cl. ..... 337/124; 337/125; 337/139; 337/141

[58] Field of Search ..... 337/35, 102, 123-125, 337/141, 324, 377, 135, 138, 103, 104, 372, 137, 140

[56] References Cited

U.S. PATENT DOCUMENTS

| | | | |
|---|---|---|---|
| 1,150,706 | 8/1915 | Ryan | 337/124 |
| 2,243,563 | 5/1941 | Hottenroth | 337/124 |
| 3,312,802 | 4/1967 | Ryckman | 337/102 |
| 3,805,207 | 4/1974 | Grimshaw | 337/135 |
| 3,846,726 | 11/1974 | Hierholzer et al. | 337/102 |

FOREIGN PATENT DOCUMENTS

| | | | |
|---|---|---|---|
| 461166 | 8/1913 | France | 337/141 |

*Primary Examiner*—William H. Beha, Jr.
*Attorney, Agent, or Firm*—Edward C. Walsh

[57] ABSTRACT

A thermally actuated switch which embodies an active unit which includes a heat responsive element which is part of an enclosure enclosing electrical resistance elements for heating. Heat is applied internally to the enclosure and cooling is by way of dissipation of heat externally from the enclosure. The thermally responsive element is in the form of a flat plate which expands lengthwise. The plate engages the shorter arm of a pivoted bell crank lever, which along with the leaf spring engages the actuating member to be actuated.

16 Claims, 4 Drawing Figures

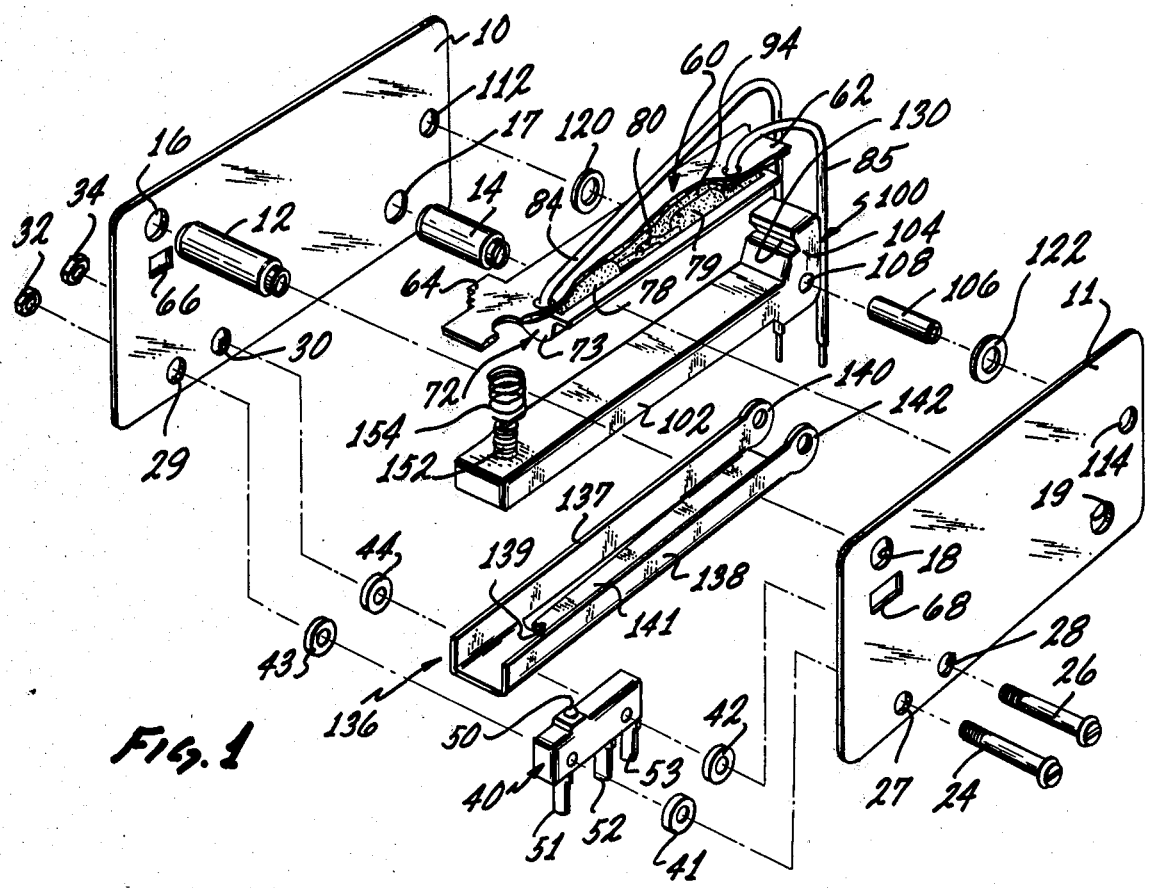
FIG. 1
FIG. 2
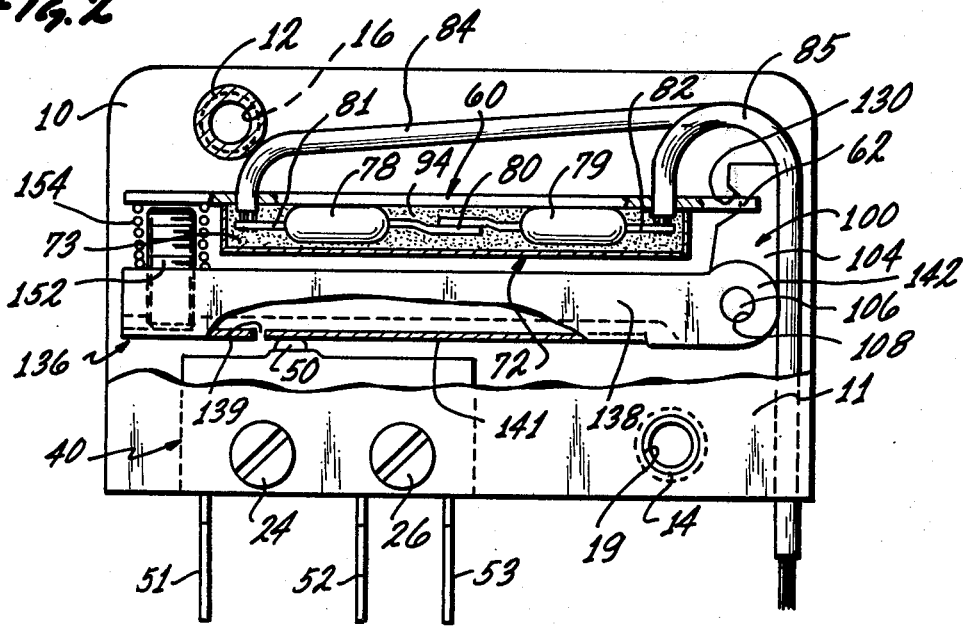

THERMALLY ACTUATED TIME DELAY SWITCH

BACKGROUND OF THE INVENTION

1. Field of the Invention

The field of the invention is that of thermally actuated switches. The switch of the invention has very significant improved characteristics and capabilities not presently available in prior art thermally actuated switches.

2. Description of the Prior Art

Thermally actuated time delay switches are not basically new. Typically, they are of simple construction, reasonably reliable and inexpensive.

However, because of the generally simple design calculated to keep costs low, known such switches have inherent weaknesses which are objectionable and can even result in failure.

Typically conventionally designed heating elements associated with thermal switches are externally wound and/or use actuating members embodying a winding mandrel and/or are wire wound requiring extremely impractical element wire sizes to do so and resulting in limiting the elements to low voltage ie. 120 volts and often this is unattainable requiring 24 volt or lower for heat.

The hereinafter stated objects identify improvement characteristics in the herein invention which the prior art does not have and which represent deficiencies in the prior art, or lack of desirable characteristics.

SUMMARY OF THE INVENTION

An exemplary form of the invention is briefly identified in the abstract. The nature of the exemplary form of the invention will be fully understood from the following stated objects and the detailed description.

The invention is a thermally actuated switch embodying basically new characteristics and capabilities.

The switch of the invention embodies a thermally responsive unit which forms an enclosure for electrical resistance heating means so that heat is applied to the enclosure from the inside. The enclosure includes a thermally responsive element which is in the form of a flat plate forming a side of the enclosure and which expands lengthwise when subjected to heat. On the cooling cycle, heat is dissipated from the unit by flowing outwardly or externally therefrom as opposed to the path of heat input which is internal.

The thermally responsive element is associated with a pivoted bell crank lever, engaging the shorter arm of the lever so as to rotate the lever when the thermally responsive unit expands longitudinally. The bell crank lever engages a pivoted leaf spring which in turn has contact with the actuating element of a switch, which may be a commercial type of microswitch.

The switch as a whole is of simplified construction, embodying a minimum number of parts and is designed so that it can be effectively constructed in very small miniature sizes while still retaining its effectiveness and being operative in response to relatively low wattages or energy.

The objects of the invention include the following. Primarily to improve the timing, accuracy and controllability by providing for separation as between the factors involved in the heating and cooling modes. In other words, to separately control heating and cooling times in the cycle.

Another object is to conserve electrical heating energy and further to realize this by positioning the electrical heater inside of the active thermally responsive unit.

A further object is to realize the possibility of effecting or controlling the cooling time by removing all insulation incidental to the heating element from the cooling or heat dissipating side or phase and controlling cooling time by way of control of element mass, altering cooling area, varying insulation, and in similar measures.

Another object is to electrically control the heat input through voltage control wherein desirable heating element expansion is achieved.

Another object is to utilize types of elements not subject to limitations of this sort and utilizing a center core design of resistance elements that are free of the limitations of the externally wound mandrel type resistance windings and thus possible to build for use on almost any heater voltages, for example as high as 480 volts or even more. This is practically impossible with externally wire-wound heater elements in these small packages.

Another object is to assist in accomplishing the foregoing by use of a flat stamped expansion element which expands linearly and which is configurated to provide a fulcrum point thus eliminating any welded or brazed parts for absolute dimensional control.

Another object is to provide an element capable of non-distorting expansion and also retention/conduction of heat resulting in virtually 100% efficiency of applied heat versus expansion.

Another object is to realize an active expansion element structured to be rigid and non-deforming yet with minimum mass. Ancillary to this object is that of aligning all elements to have a common plane of symmetry.

Another object is to realize a design that is compact and simple embodying only two simple side plates which retain the switch, the plates being stressed along the plane of the material and having the same coefficient of thermal expansion as the active expansion element and preferably made of the same material. Preferably all elements are of stainless steel or other material with a high thermal coefficient of expansion.

Another object is to provide protection for the switch and to prevent physical contact to heated parts to avoid burns.

Another object is to realize a product in which all the working elements are of identical materials so that the design is inherently ambient temperature compensated.

A further object is to realize the capability of operation at higher temperatures, use of a rigid structure permitting size reduction.

Another object is to realize a combination in which after the switch operates the heat is automatically cut off or reduced to the heating elements to facilitate separate control of the heating and cooling.

Further objects and additional advantages of the invention will become apparent from the following detailed description and annexed drawings.

BRIEF DESCRIPTION OF THE DRAWINGS

FIG. 1 is an exploded view of a preferred form of the invention;

FIG. 2 is a view partly in cross section of the form of the invention of FIG. 1;

DESCRIPTION OF THE PREFERRED EMBODIMENT AND BEST MODE OF PRACTICE

Figure 3:
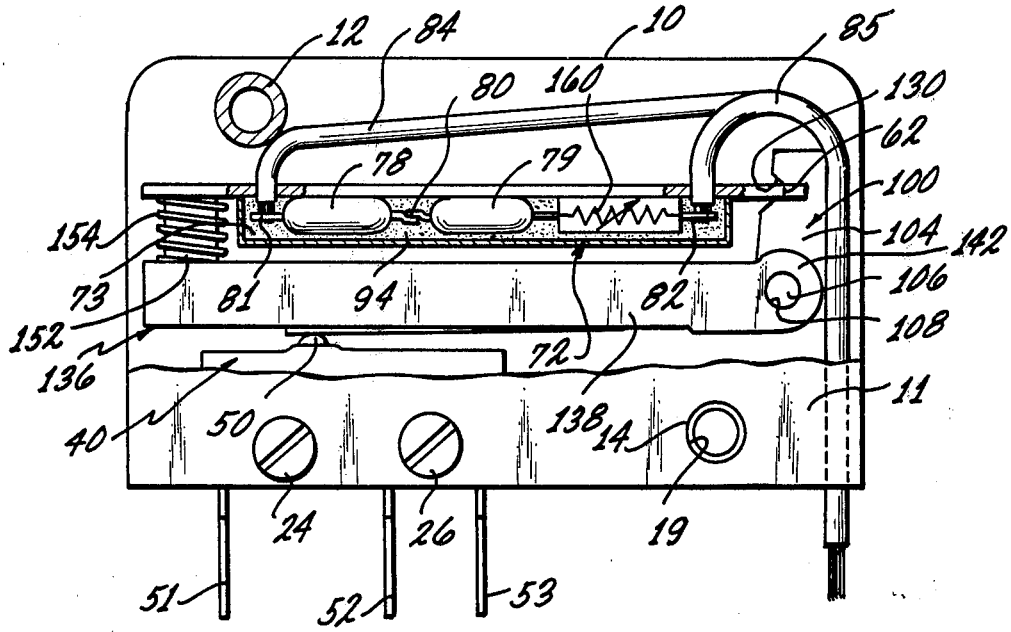
FIGS. 3 and 4 are views of modified forms of the invention.

An exemplary form of the invention is shown in FIGS. 1 and 2. The invention can be constructed in very small or miniature sizes, such as for example 1½ inches by 1 inch. In the exemplary form of the invention there are two side plates as designated at 10 and 11. All of these parts of the switch are preferably made from material having the same coefficient of thermal expansion, or the same material which may be stainless steel, for example. The plates are held parallel to each other by way of spacer member 12 and 14, the ends of which are reduced diameter and which fit into holes in the plates as designated at 16 and 17 in the plate 10 and 18 and 19 in the plate 11.

The plates are further held together by bolts as designated at 24 and 26 which extend through holes 27 and 28 in plate 11 and holes 29 and 30 in plate 10 and which are secured by nuts 32 and 34.

The bolts extend through openings provided in microswitch 40 shown in FIG. 1 which is held between the plates, there being washers on opposite sides of the microswitch as designated at 41, 42, 43, and 44.

The microswitch may be of a known commercial type having an actuator button 50, the switch typically being snap acting and having terminals 51, 52, and 53.

The thermally active part of the switch is shown in the exploded view, FIG. 1 and in the cross sectional view FIG. 2. Numeral 60 designates a heat responsive element which is preferably a stainless steel plate formed as a single stamping having a shape as shown. At one end it has a recess out into it as designated at 62 for a purpose which will be described presently. At the other end it has a pair of extending ears or lugs, one of which is shown at 64 which are adapted to be received in rectangular openings 66 and 68 in the plates 10 and 11 for a purpose of which will be described.

Numeral 72 designates a flanged member which forms a trough 73 having two side flanges as may be seen in FIG. 1 which are secured such as by welding to the underside of the plate 60 forming an enclosure for the thermally active element or material.

The thermally active element or elements are designated at 78 and 79 being resistors of commercial construction which are connected together as shown at 80 and having end terminals 81 and 82 to which are connected leads 84 and 85.

The heating resistance elements 78 and 79 within the enclosure formed by the plate 60 and member 72 and may be potted in or embedded in suitable material as designated at 94. From the foregoing it may be seen that the application of heat to the expansible element 60 is from the inside or internally whereas the dissipation of heat from the unit is through another path, that is, outwardly from the unit.

Internal heating elements are most efficient as no generated heat is lost as it can only be dissipated by flowing out through the thermally active element.

Numeral 100 designates a lever element which is in the form of a bell crank lever having a longer arm 102 and a shorter arm 104 which operate around the pivot member 106 which passes through a hole 108 in the member 100. The ends of the arbor or pin member 106 are received in holes 112 and 114 in the plates 10 and 11 with washers 120 and 122 positioned on the pin 106 on opposite sides of the member 100.

The shorter arm 104 has formed a groove on the inside of it as designated at 130 which forms a fulcrum or pivot point for the recessed end 62 of the active plate member 60 as will be described.

Numeral 136 designates a rigid lever preferably constructed of the same material which is of channel shape as shown having side flanges 137 and 138 which have extending end parts 140 and 142, each of which has a hole in it to be received on the pin 106.

The bottom of the channel member 39 has a longitudinal cutout in it as shown at 139. In this cutout is a flexible leaf spring member 141 the end of which is not separated from the bottom of the channel member 136. It is this member that engages the actuator button 50 of the microswitch 40 to provide a limited degree of resiliency which serves the purpose of preventing the microswitch from stalling or hanging up or being held in one of its positions or an intermediate position.

The member 100 fits into the channel formed in the member 136 as may be seen in FIG. 2, both of these parts being able to pivot around the center formed by a pin 106.

The underside of the member 136 engages the actuating button 50 of the switch 40 as may be seen in FIG. 2.

At an end part of the active plate member 60 there is a hole 150 through which access may be had to an adjusting screw 152 which threads into the part 102 of lever 100, there being a coil spring 154 around this screw between the part 102 and the end of the plate member 60. The screw provides an adjustment which is able to compensate for production tolerances in the system when assembled.

From the foregoing, it may be seen that in the assembled position of the parts the recessed end 62 of the plate 60 is received in the slot or grooves 130 which forms a fulcrum. The spring 154 urges the parts 60 and 100 apart subject to adjustment to compensate for production tolerances as described above.

The invention as so far described possesses certain characteristics and capabilities which are important and to which attention is called. The switch is completely self-compensated for ambient temperatures. This derives from the fact that all of the parts or components of the switch are preferably made from materials having the same coefficient of thermal expansion or on the other hand all are made from the same material. Thus it is to be seen that the device can be utilized in environments involving a very wide range in change in temperature while the switch remains compensated. This is particularly significant considering that the switch may be built in very small miniature sizes wherein the amount of expansion of the expansible thermal element may amount to only perhaps 0.003 inches.

A further significant characteristic of the switch is that, as is to be noted, all of the basic components of the actuating mechanism lie in a single plane or have a common plane of symmetry. In the construction shown this plane is a plane parallel to the two side plates. By reason of this construction the components are not subject to distorting or twisting moments with the result that the rigidity is improved and increased. This consideration applies to "g" forces as well, which otherwise because of geometry of the parts might produce distortion. The outside plates are, of course, reversible because they are just alike.

The switch can be used with a cover if desired. The terminals of the microswitch are insertable into receptacles in a printed circuit board so that the switch itself is mounted right on the board. When so mounted, it occupies a minimum of space on the board. On the other hand, the switch can be attached to a circuit board or a base in an upside down position with the microswitch terminals sticking up. It would be attached in this manner preferably by a metal band. Then quick connectors can be directly attached to the terminals of the microswitch, these quick connectors normally being supplied with the microswitch. The volume occupied by the switch and its active elements is minimized and ordinarily will represent only a fraction of the volume required by other types of units. From the foregoing it will be understood that the switch has characteristics such that it can compete with other units having similar functions even at high switch capacities and in the areas of volume/space requirements even as respects various types of electronic assemblies.

DESCRIPTION OF OPERATION AND BEST MODE OF PRACTICE

In the position of the parts as shown; pressure is being exerted on the button 50 of the switch 40 through member 141 placing it in one of its positions which may be either one or the other.

When heat is applied to the thermal switch through the lead 84 and 85 heat is generated by the elements 78 and 79 which heats the plate 60 which expands longitudinally to thereby exert a force against the short arm 104 of the bell crank lever 100. The expansion in a preferred embodiment of the invention might be approximately three thousandths of an inch, for example. The force causes the lever 100 to rotate slightly about the pin 106 against the spring 154 so as to release the pressure on the button 50 so as to allow the microswitch 40 to operate to its opposite position.

It is to be noted that when the plate 60 expands longitudinally and rotates the lever 100 there occurs a slight angular movement of the plate 60; this is accommodated for by the lugs, like the lugs 64 on the plate 60, fitting in the openings 66 and 68 loosely enough to accommodate this slight amount of rotation.

FIG. 3 shows a modified form of the invention wherein there is included within member 72 a Thermistor element 160 which is in series with the heating elements 78 and 79. As is shown, this is a type of element the resistance of which varies with temperature. In this case the resistance increases as the temperature increases so that during the time elements 78 and 79 are energized the resistance in the circuit of the elements increases so as to cut down the current flow thereby reducing energy requirements, unnecessary heating and contributing to the ability to separately control the heating and cooling time.

Figure 4:
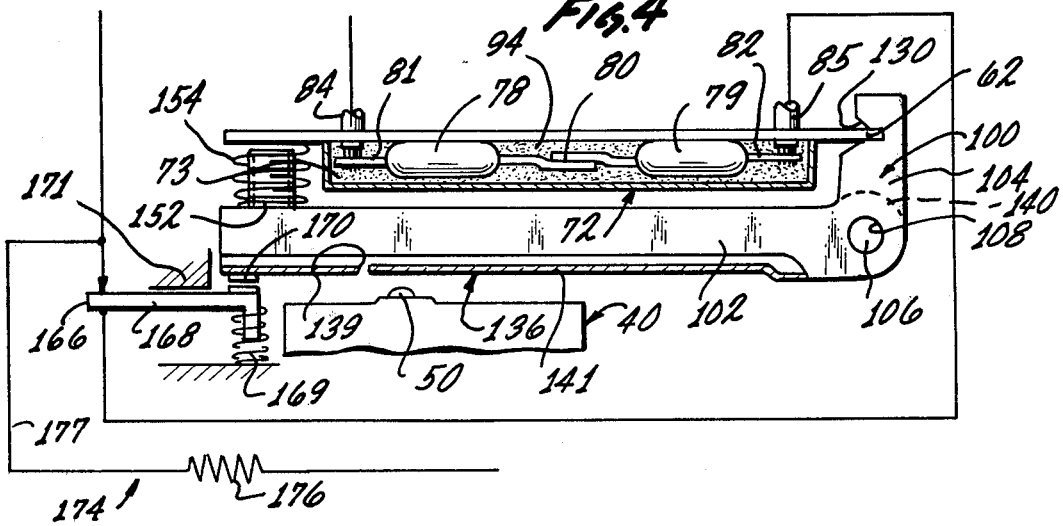

FIG. 4 illustrates a further form of the invention which operates similarly to that of FIG. 3. In this form of the invention there is provided a switch contact 166 which is normally in the circuit of the heating elements 78 and 79 and circuit wires 84 and 85 as shown. It is carried on a member 168 which operates against coil spring 169 and is engageable by an abutment 170 carried on the lever member 136. In its upper position it engages a stop 171. Numeral 174 designates a branch circuit having in it a resistor 176.

In operation after the microswitch 40 has been operated by the button 50 the lever member 136 will engage the member 168 and will cause the contact 166 to open which will open the circuit through the heating elements 78 and 79 interrupting the primary circuit through them. Numeral 176 designates a resistor which is in a branch circuit 177. Preferably after the contact 166 has opened the circuit through the heaters 78 and 79 is through the resistor 176 thereby decreasing the power supplied and resulting heating effect of the heaters 78 and 79. Optionally, of course, the branch circuit 177 and resistor 176 can be omitted altogether. Thus the function and effect of the arrangement shown in FIG. 4 is similar to that in FIG. 3.

From the foregoing those skilled in the art will readily observe that the invention as described has all the features and characteristics that have been identified in the foregoing. Further, those skilled in the art will be readily able to perceive from the description how all of the specific objects and advantages as identified in the foregoing are realized by the invention. As pointed out, the thermally actuated switch can readily be constructed in miniature sizes still having the same degree of effectiveness and fully operative with relatively low applied energy.

The cooling time is readily controllable relative to the heating time of the switch, that is, speaking of times required for actuation of the microswitch. The cooling time is determined by dissipation of heat from the active unit, that is, through a different path than the path utilized to put heat into the unit, the heating elements being enclosed as described. The cooling time can readily be adjusted in various ways, which is for example, by painting onto the plate 60 covering it with a layer of epoxy of a thickness as desired to regulate the cooling time, the concept being that a coating is utilized in a way to control the rate of dissipation of heating during cooling. Cooling time is controlled by maximum element temperature, mass and/or insulation.

As may be seen, by adjusting the screw 152 a desired degree of pressure can be caused to be exerted against the member 136 so that the thermal switch can readily be adjusted to activate as between on and off positions of the switch 40 as desired.

The foregoing disclosure is representative of preferred forms of the invention and is to be interpreted in an illustrative rather than a limiting sense, the invention to be accorded the full scope of the claims appended hereto.

What is claimed is:

1. In a thermally actuatable switch in combination, a unit including a deformable heat responsive element, the unit forming an enclosure, electrical resistance means positioned within the enclosure to provide a source of heat within the enclosure, the said thermally responsive element having exposure to the exterior of the unit to allow dissipation of heat externally from the unit, means including electrical contacts operable by deformation of the heat responsive element whereby the time for response due to heating and for response due to cooling can be separately controlled.

2. An article as in claim 1 wherein said thermally responsive element is in the form of a flat plate constructed to expand longitudinally and means whereby deformation of the said plate can actuate the said contacts.

3. An article as in claim 1 including a bell crank lever mounted for angular movement and having a long arm and a short arm, the said thermally responsive element having engagement with the short arm for rotating the said lever and means providing engagement as between the lever and the said contact means for actuating them.

4. An article as in claim 3 including an elongated member having an end part positioned to move pivotally about the axis of said lever and positioned between the said lever and the said contact means, said member including a resilient portion engageable with the contact means.

5. An article as in claim 1 wherein said unit includes a member secured to the said heat responsive element having an intermediate part providing an enclosure for the electrical resistance means.

6. An article as in claim 1 including control means for the electrical resistance means and means whereby said control means control the power supply to the electrical resistance means.

7. An article as in claim 6 wherein said control means includes a Thermistor within said enclosure and in series with said electrical resistance means.

8. An article as in claim 6 wherein said control means includes contact means operable by the said heat responsive element.

9. An article as in claim 8 including circuit means having a resistance whereby the said control means reduces the power supply to the electrical resistance means through operation of said electrical contact means.

10. An article as in claim 1 including an elongated member including a leaf spring having an end part positioned to move pivotally about the axis of said lever and positioned between the said lever and the said actuator.

11. In a thermally actuatable switch in combination, a pair of side plates, means including spacer members holding the side plates in spaced relationship, a unit including a deformable heat responsive element positioned between the side plates, the said unit including a lever member having engagement with the heat responsive element and including a pivot member and, the lever member being mounted to be movable angularly about the said pivot member, the said side plates and the parts of the unit being constructed of material having the same coefficient of thermal expansion whereby the entire unit is self-compensated for ambient temperatures.

12. A thermally actuatable switch as in claim 11, the said heat responsive element being positioned whereby to expand longitudinally and to cause the lever member to rotate about its pivot.

13. In a thermally actuatable switch in combination, a unit including a deformable heat responsive element, a controlling member positioned to be actuatable by the heat responsive element, means providing connections between the heat responsive element and the controlling member, a mounting means carrying the heat responsive element and the said connections, the said heat responsive element, said connections and the mounting means being constructed of material having the same coefficient of thermal expansion whereby the entire unit is self compensated for ambient temperature.

14. In a thermally actuatable switch in combination, a unit including a deformable heat responsive element, electrical resistance means to provide a source of heat, means including an actuator and electrical contacts operable by deformation of the thermally responsive element, means including a pivoted bell crank lever having a shorter arm positioned to be rotated by deformation of the heat responsive element, and means providing for engagement between the lever and said actuator, said heat responsive element being in the form of a flat plate constructed to expand longitudinally and means whereby deformation of the said plate engages said shorter arms to actuate the said contacts.

15. In a thermally actuatable switch in combination, a unit including a deformable heat responsive element, electrical resistance means to provide a source of heat, means including an actuator and electrical contacts operable by deformation of the thermally responsive element, means including a pivoted bell crank lever having a shorter arm positioned to be rotated by deformation of the heat responsive element, and means providing for engagement between the lever and said actuator, the said unit including a member secured to the said heat responsive element having an intermediate part providing an enclosure for the electrical resistance means whereby heat is put into the unit internally and dissipates through the external path.

16. In a thermally actuatable switch in combination, a unit including a deformable heat responsive element, electrical resistance means to provide a source of heat, means including an actuator and electrical contacts operable by deformation of the thermally responsive element, means including a pivoted bell crank lever having a shorter arm positioned to be rotated by deformation of the heat responsive element, and means providing for engagement between the lever and said actuator, the said unit having a construction whereby the time of response due to heating and for response due to cooling can be separately controlled.

* * * * *